United States Patent [19]

Karol

[11] Patent Number: 4,880,437

[45] Date of Patent: Nov. 14, 1989

[54] FUEL COMPOSITIONS CONTAINING MALEIC DERIVATIVES OF 2,5-DIMERCAPTO-1,3,4-THIADIAZOLE

[75] Inventor: Thomas J. Karol, Norwalk, Conn.

[73] Assignee: R. T. Vanderbilt Company, Inc., Norwalk, Conn.

[21] Appl. No.: 171,089

[22] Filed: Mar. 21, 1988

[51] Int. Cl.[4] ..... C10L 1/10

[52] U.S. Cl. ..... 44/57; 44/63

[58] Field of Search ..... 548/142; 44/63, 57; 252/47.5

[56] References Cited

U.S. PATENT DOCUMENTS

| | | | |
|---|---|---|---|
| 2,764,547 | 9/1956 | Fields | 252/32.7 |
| 3,980,573 | 9/1976 | Okurodudu | 252/46.7 |
| 4,140,643 | 2/1979 | Davis | 252/47.5 |
| 4,193,882 | 3/1980 | Gemmill | 252/47.5 |
| 4,282,007 | 8/1981 | Sung | 44/63 |
| 4,410,703 | 10/1983 | Okorodudu | 548/142 |
| 4,584,114 | 4/1986 | Gemmill et al. | 252/47.5 |
| 4,659,337 | 4/1987 | Sung | 44/63 |
| 4,689,051 | 8/1987 | Sung | 44/57 |

FOREIGN PATENT DOCUMENTS 0223916 6/1987 European Pat. Off. .

OTHER PUBLICATIONS

Related U.S. S. No. 07/045,652, Karol, 05/04/87.

*Primary Examiner*—William R. Dixon, Jr.
*Assistant Examiner*—Margaret B. Medley
*Attorney, Agent, or Firm*—Rasma B. Balodis

[57] ABSTRACT

A diesel fuel composition comprising a major portion of middle distillates and a minor wear improving amount of a reaction product of one mole of a maleic compound and one mole of 2,5-dimercapto-1,3,4-thiadiazole which may be further reacted in the 5-position with one mole of maleic compound or one mole by alpha-pinene.

5 Claims, No Drawings

FUEL COMPOSITIONS CONTAINING MALEIC DERIVATIVES OF 2,5-DIMERCAPTO-1,3,4-THIADIAZOLE

BACKGROUND OF THE INVENTION

The present invention concerns improved fuel compositions. More particularly, it relates to diesel fuel compositions having improved wear resistance.

Internal combustion engines, particularly diesel engines are susceptible to wear in the upper cylinder region. It is believed that the majority of wear occurring in the upper cylinder is caused by the upward motion of the piston. While lubricating oils prevent wear on the downward stroke, the lubricating oil has no contact with the cylinder wall on the upward motion. During the upward compression stroke only the fuel is in contact with the cylinder wall and can influence its wear.

Accordingly, it is an object of the invention to provide diesel fuel having improved antiwear properties.

It is known that reaction products of a maleic compound and 2,5-dimercapto-1,3,4-thiadiazole impart antioxidant and antiwear properties to lubricating oils as described in U.S. patent application Ser. No. 07/045,652 filed May 4, 1987.

It has been now discovered that a certain group of the reaction products impart antiwear properties to diesel fuel.

SUMMARY OF THE INVENTION

In accordance with the invention, there are provided diesel fuel compositions having improved antiwear properties and comprising a major portion of a diesel fuel and a minor wear resistance imparting portion of a reaction product of a maleic compound and 2,5-dimercapto-1,3,4-thiadiazole selected from the group of compounds having the structural formula

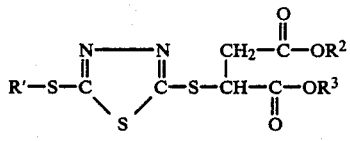

(I)

wherein R′ represents hydrogen, pinene residue of the formula

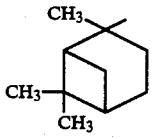

and maleic and residue of the formula

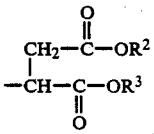

and $R^2$ and $R^3$ represent alkyl and cycloalkyl groups and either $R^2$ and $R^3$ may be hydrogen; neutralization salts of said compounds and mixtures thereof.

DESCRIPTION OF SPECIFIC EMBODIMENTS

The reaction products of the invention may be prepared by reacting one mole of 2,5-dimercapto-1,3,4-thiadiazole with one or two moles of maleic acid or maleic anhydride. The obtained alpha-substituted maleic derivative may be subsequently converted to the ester or half ester by reacting with an alcohol. The half ester may form on either acid group and the product is probably a mixture of both esters. Alternately, the products may be prepared directly through either the half or full ester of maleic acid.

The reaction may be conducted in an inert organic solvent such as toluene. To accelerate the rate of reaction, the reaction may be conducted in the presence of acid or Lewis acid catalysts such as methanesulfonic acid. The reaction products containing acid groups may be further reacted with inorganic metal compounds to form neutralization salts of said products. The metal compounds useful for neutralization may be selected from, among others, carbonates and oxides of sodium, calcium, magnesium and zinc. Typically, the reaction temperature will range from about 80° C. to 140° C.

The pinene derivative may be prepared by reacting the above described monomaleic derivative with alpha-pinene according to the method described in U.S. Pat. No. 2,764,547.

Groups $R^2$ and $R^3$ in the formula I represent alkyl groups containing 1 to 22 carbon atoms and cyclic aliphatic groups such as cyclohexyl, cyclopentyl and cycloheptyl. Preferably the total number of carbon atoms of $R^2$ and $R^3$ ranges from 8 to 44.

The reaction products may be added to diesel fuel in an effective amount to impart antiwear properties. The effective amount may range from about 0.001 to 2.0 percent and preferably from about 0.01 to 1.0 percent.

Diesel fuels are petroleum refinery products commonly known as middle distillates. These fuels are complex mixtures of many different hydrocarbons. The properties of commercial diesel fuels depend on the refining process and the nature of the crude oil from which it is derived. Generally, the boiling range of the fuels is between 163° to 400° C. and the kinematic viscosity at 40° C. ranges between 1.3 to 24.0 cSt.

The preferred diesel fuels are fuel oils complying with ASTM specifications compiled in Table I.

TABLE I

Specifications for Diesel Fuel Oils, ASTM D975-78

| Property | Grade 1-D | Grade 2-D | Grade 4-D |
|---|---|---|---|
| Distillation (90%) point, °C. | 288 max. | 282–338 | — |
| Flash point, °C. | 38 | 52 | 55 |
| Viscosity at 40° C. kinematic, $mm^2/s$ (= cSt) | 1.3–2.4 | 1.9–4.1 | 5.5–24.0 |
| Cetane number, min. | 40 | 40 | 40 |

The properties of the fuel affect directly the power, economy, performance and wear of the engine. In addition to the wear inhibiting additive, diesel fuels may contain other additives to enhance their properties. These additives may be ignition quality improvers, oxidation inhibitors, biocides, rust preventives, metal deactivators, pour point depressors, emulsifiers, smoke suppressants and dispersants.

The following examples are given for the purpose of further illustrating the invention. All percentages and parts are based on weight unless otherwise indicated.

EXAMPLE I

The additives of the invention were evaluated by the Shell Four-Ball Wear Test.

The test was conducted essentially according to the method described in ASTM D-2266 procedure. Four lightly polished steel ballas 12.5 mm in diameter were placed in a test cup and submerged in the test sample. The test fuel was D-2 diesel fuel manufactured by Texaco, Inc. The test was carried out at a rotation speed of 1800 rpm under a load of 40 kg for one hour at 93.3° C.

The additives of the invention were added to the oil in the amount indicated in Table II. Fuel compositions containing the present additives show improved antiwear properties.

TABLE II

FOUR-BALL WEAR TEST

| Sample | Active Ingredient | Percent | Scar, mm |
|---|---|---|---|
| 1 | None | — | 1.82 |
| 2 | 2,5-Bis(1,2-dihexoxycarbonyl-ethylthio)-1,3,4-thiadiazole | 0.50 | 1.29 |
| 3 | 2-(2-Pinanylthio)-5-(1,2 dihexoxycarbonylethylthio)-1,3,4-thiadiazole | 0.50 | 1.40 |
| 4 | 2-(1,2-Di(2-ethylhexoxycarbonyl)-ethylthio-1,3,4-thiadiazole | 0.50 | 0.92 |

The above embodiments have shown various aspects of the present invention. Other variations will be evident to those skilled in the art and such modifications are intended to be within the scope of the invention as defined by the appended claims.

What is claimed is:

1. A diesel fuel composition characterized by improved wear properties and comprising a major portion of middle distillates boiling in the range of about 163° to 400° C. and a minor wear improving amount of a reaction product of a maleic compound and 2,5-dimercapto-1,3,4-thiadiazole selected from the group of compounds having the structural formula

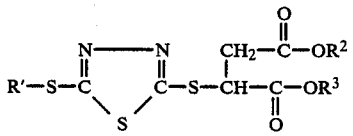

wherein R′ represents hydrogen, pinene residue of the formula

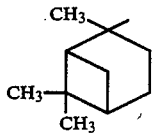

and maleic acid residue of the formula

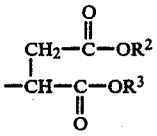

and $R^2$ and $R^3$ represent $C_{1-22}$ alkyl and $C_{5-7}$ cycloalkyl groups and either $R^2$ or $R^3$ may be hydrogen; neutralization salts of said compounds and mixtures thereof.

2. The fuel composition of claim 1 wherein the reaction product is present in the amount ranging from about 0.001 to 2.0 percent by weight based on the weight ot the fuel composition.

3. The fuel composition of claim 1 wherein the reaction product is 2-(1,2-di(2-ethylhexoxycarbonyl)ethylthio)-5-mercapto-1,3,4-thiadiazole.

4. The fuel composition of claim 1 wherein the reaction product is 2,5-bis(1,2-dihexoxycarbonylethylthio)-1,3,4-thiadiazole.

5. A method of improving the wear resistance of a diesel fuel which comprises adding to diesel fuel about 0.001 to 2.0 percent of a reaction product of a maleic compound and 2,5-dimercapto-1,3,4-thiadiazole selected from the group of compounds having the structural formula

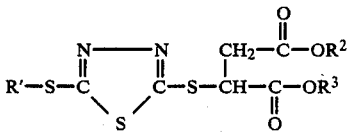

wherein R′ represents hydrogen, pinene residue of the formula

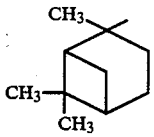

and maleic acid residue of the formula

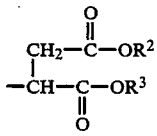

and $R^2$ and $R^3$ represent $C_{1-22}$ alkyl and $C_{5-7}$ cycloalkyl groups and either $R^2$ or $R^3$ may be hydrogen; neutralization salts of said compounds and mixtures thereof.

* * * * *

UNITED STATES PATENT AND TRADEMARK OFFICE

CERTIFICATE OF CORRECTION

PATENT NO. : 4,880,437

DATED : Nov. 14, 1989

INVENTOR(S) : Thomas J. Karol

It is certified that error appears in the above-identified patent and that said Letters Patent is hereby corrected as shown below:

Title page [57] Abstract, last line

"or one mole by alpha-pinene" should be
-- or one mole of alpha-pinene --;

Column 1, line 57
"and maleic and residue" should be
-- and maleic acid residue --;

Column 1, line 67
"and either $R^2$ and $R^3$" should be
-- and either $R^2$ or $R^3$ --;

Claim 2, column 4, line 23
"weight ot the fuel" should be
-- weight of the fuel --.

Signed and Sealed this

Twenty-third Day of October, 1990

*Attest:*

HARRY F. MANBECK, JR.

*Attesting Officer*

*Commissioner of Patents and Trademarks*